US007980402B2

(12) United States Patent
Brendel

(10) Patent No.: US 7,980,402 B2
(45) Date of Patent: Jul. 19, 2011

(54) RADIO REMOTE CONTROL DEVICE FOR A WORKING MACHINE

(75) Inventor: Wolfgang Brendel, Crailsheim (DE)

(73) Assignee: Huber und Brendel Inhaber: Wolfgang Brendel, Crailsheim (DE)

( * ) Notice: Subject to any disclaimer, the term of this patent is extended or adjusted under 35 U.S.C. 154(b) by 522 days.

(21) Appl. No.: 12/089,659

(22) PCT Filed: Oct. 6, 2006

(86) PCT No.: PCT/EP2006/009692

§ 371 (c)(1),
(2), (4) Date: Apr. 9, 2008

(87) PCT Pub. No.: WO2007/042222

PCT Pub. Date: Apr. 19, 2007

(65) Prior Publication Data

US 2008/0210653 A1 Sep. 4, 2008

(30) Foreign Application Priority Data

Oct. 10, 2005 (DE) ..... 10 2005 048 386

(51) Int. Cl.
*B66C 13/40* (2006.01)

(52) U.S. Cl. ..... 212/285; 340/825.72; 341/176

(58) Field of Classification Search ..... 212/285; 340/825.72; 341/176
See application file for complete search history.

(56) References Cited

U.S. PATENT DOCUMENTS

| | | | | |
|---|---|---|---|---|
| 4,306,314 | A | 12/1981 | Griffiths | |
| 4,614,274 | A * | 9/1986 | LaValle et al. | 212/285 |
| 5,030,955 | A * | 7/1991 | Durst et al. | 341/176 |
| 5,453,758 | A * | 9/1995 | Sato | 345/158 |
| 6,346,891 | B1 * | 2/2002 | Feinleib et al. | 340/825.69 |
| 6,545,607 | B2 * | 4/2003 | Bredow et al. | 340/573.1 |
| 6,634,514 | B2 * | 10/2003 | Ducrot | 212/285 |

FOREIGN PATENT DOCUMENTS

| | | |
|---|---|---|
| DE | 32 34 395 A1 | 3/1984 |
| JP | 04 116324 A | 4/1992 |
| JP | 08 169685 A | 7/1996 |

* cited by examiner

*Primary Examiner* — Thomas J. Brahan
(74) *Attorney, Agent, or Firm* — Rothwell, Figg, Ernst & Manbeck, P.C.

(57) ABSTRACT

The invention relates to a radio remote control unit for an operating device, comprising a radio transmitter for transmitting control command signals for the operating device and a radio reception unit assigned to the operating device for receiving control command signals of the radio transmitter and for converting the control command signals into control signals for controlling the operating functions of the operating device, characterized in that the radio transmitter has a sensor unit for detecting at least one irregular force induction state and/or an irregular movement state and/or at least one irregular positional state of the radio transmitter and is equipped to change its radio transmission performance in a specific manner on detection of the irregular state, and the radio reception unit is equipped to trigger an emergency control signal on detecting the specific change in the radio transmission performance of the radio transmitter to influence the operating functions of the operating device in a predetermined manner.

16 Claims, 1 Drawing Sheet

RADIO REMOTE CONTROL DEVICE FOR A WORKING MACHINE

CROSS REFERENCE TO RELATED APPLICATION

This application is a 35 U.S.C. 371 National Phase Entry Application from PCT/EP2006/009692, filed Oct. 6, 2006, which claims the benefit of German patent application Ser. No. 10/2005 048 386.0 filed on Oct. 10, 2005, the disclosure of which is incorporated herein in its entirety by reference.

The invention relates to a radio remote control unit for an operating device, having a radio transmitter for transmitting control command signals for the operating device and having a radio reception unit assigned to the operating device for receiving control command signals of the radio transmitter and for converting the control command signals into control signals for controlling operating functions of the operating device.

It is known that such radio remote control units may be used with hauling gear and hoisting gear, in particular with cranes, to control their operating movements. The operator of a crane therefore carries the portable radio transmitter with him and can issue control commands to the radio transmitter, these commands then being converted into control command signals by the radio transmitter. The control command signals sent by the radio transmitter are received by the radio reception unit of the crane and converted into control signals for controlling the operating functions of the crane. These operating functions may include, for example, rotation of the crane on a rotary tower crane, including movements of the traveling crab in the case of a crane with a traveling crab jib and hoisting gear functions.

To specify the control command signals, the radio transmitters are equipped with operating elements such as buttons, joystick levers, etc. It is already known that such a radio transmitter may be equipped with an emergency cutout operating element. In the case of radio remote control of a crane, a radio message can be sent by operating the emergency cutout operating element on the radio transmitter, which message is then interpreted by the radio reception unit of the crane and leads to emergency deactivation of movement functions of the crane. The emergency cutout signal is usually transmitted actively as a control command from the radio transmitter to the radio reception unit or is transmitted passively by the fact that the radio transmitter interrupts the radio connection to the radio reception unit. The radio reception unit interprets the lack of a radio contact as an emergency cutout situation and orders deactivation of the movement functions of the crane and/or deactivation of the crane electric system via the crane control. The lag times between indicating the emergency cutout situation and the deactivation response on the crane may amount to a few seconds, e.g., max. 0.55 seconds in the case of the emergency deactivation triggered by an active control command or max. 2 seconds in the case of passive emergency deactivation.

The portable radio transmitters are usually designed as handheld devices or as shoulder-strap devices. The handheld devices are often designed to be relatively small and lightweight and resemble cordless telephone terminals in terms of the visual appearance. In many cases they can be operated with one hand. The shoulder-strap devices are usually somewhat larger control units, which can be worn by the operator in front of his body, with the device attached to a strap around the neck.

In particular in the case of radio transmitter handheld devices, it may happen that in emergency situations, onehanded operation of the emergency cutout operating elements cannot readily be accomplished with the required speed, so that a dangerous situation is not dealt with too late.

The object of the invention is to provide a radio remote control unit of the type defined in the introduction, which reliably and rapidly triggers a required reaction in the operating device which prompts an emergency cutout operation, for example.

To achieve this object, it is proposed according to the invention that the radio transmitter should have a sensor device for detecting at least one irregular force induction state and/or an irregular movement state and/or at least one irregular positional state of the radio transmitter and is equipped to alter its radio transmission performance in a specified manner on detecting the irregular state, and that the radio reception unit is equipped to trigger an emergency control signal on detection of the specific change in the radio transmission performance of the radio transmitter to influence the operating functions of the operating device in a predetermined manner, in particular to limit and/or stop said functions.

An irregular force induction state occurs, for example, when the radio transmission unit experiences a relatively intense impact, e.g., by striking an object, for example, or when it hits after a falling movement. Regardless of whether the operator has intentionally or unintentionally brought about the irregular force induction state, the change in the radio transmission performance of the radio transmitter takes place in order to trigger the emergency control signal in the radio reception unit and thereby influence the operating function of the operating device in the predetermined manner. With most operating devices, the latter means that the degrees of freedom of movement are limited and/or suppressed entirely, e.g., in the sense of an emergency deactivation of the drive devices.

In one embodiment of the invention, an irregular movement state of the radio transmitter is detected when the radio transmitter executes a falling movement or a thrown movement. In addition, rolling and/or tumbling of the radio transmitter, e.g., after falling down an inclined surface, may be considered as an irregular motion state. Such an irregular state also results in security intervention in the operating functions of the operating device in the respective embodiment of the invention.

In one embodiment of the invention, an irregular positional state of the radio transmitter is detected when the radio transmission device rests with its operating field on a substrate.

The sensor device preferably comprises at least one acceleration sensor (active or passive), in particular a piezoelectric sensor and/or a capacitive sensor and/or an inductive sensor for detecting an irregular force induction state and/or an irregular movement state of the radio transmitter. According to an especially preferred embodiment, several such acceleration sensors are provided in different installed positions in the radio transmission device to be able to detect irregular states.

The sensor device is preferably combined with a signal analyzer circuit, which is equipped to decide whether a respective irregular state has occurred. Depending on the analytical program, the signal analysis may detect dynamic and/or static states of the radio transmitter, the dynamic detection taking into account the changes in sensor signals over time.

Although the term "operating device" should include all remote-controlled machines and hauling gear, one of the main focuses of the invention is on remote control of hauling gear, in particular lifting equipment.

Accordingly, the subject matter of the invention also comprises a crane as an operating device with a radio remote control unit of the type described above, with the crane comprising control means that restrict the degrees of freedom of the crane in its operating movement when the emergency control signal is triggered, in particular triggering emergency deactivation of at least one degree of freedom of the operating movement.

Therefore, if the operator loses control of the radio transmission device, so that the device experiences an unusual impact and/or executes a falling movement and/or rolls down a slope, then unintentional activation of the crane is prevented and in particular a crane movement with a potential risk due to an emergency deactivation is suppressed.

The invention is explained below with reference to FIGS. 1-4, which are like pictograms.

Figure 1:
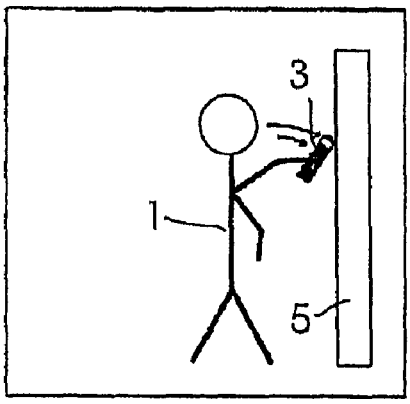
FIG. 1 shows the situation when an operator throws the radio transmission device against a wall.

FIG. 1 shows schematically an operator 1 of a crane (not shown) who is holding in one hand a radio transmission device 3 of a radio remote control unit according to the invention, and throws this radio transmission device 3 against a wall 5 in an emergency situation. The operator 1 thus induces an irregular force induction state in the radio transmission device 3, which is detected by a sensor device provided therein with acceleration sensors and/or position sensors and thus gives rise to the specific change in the radio transmission performance of the radio transmitter. This change in the radio transmission performance consists of the fact that the radio transmitter first actively transmits an emergency cutout control signal and then goes into an off state, which leads to an interruption in the radio connection to the radio reception unit of the crane. When the active emergency cutout control signal is received by the radio reception unit of the crane, there is an emergency deactivation of the crane (e.g., triggering of a stop signal to the pilot contactor on the crane end). This takes place with the shortest possible lag time. The radio reception unit is also equipped to trigger emergency deactivation of the crane when it detects the interruption in the radio transmission between the radio transmitter and radio reception unit (passive emergency cutout state). The latter intervenes if the emergency cutout control signal has not been received.

Although the combination of active and passive emergency deactivation was discussed above, in other embodiments of the invention, only active emergency deactivation and/or only passive emergency deactivation may be provided, e.g., each with a deactivation delay of max. 2 seconds.

According to FIG. 1, the operator need not first search for an emergency cutout switch on the radio transmission device 3 and operate it in the event of an emergency but instead the emergency situation may be indicated by striking the device against a resistance 5 (shock off function). The required impact strength for triggering of the emergency cutout control signal and/or for interruption of the radio signal is preferably adjustable by a program intervention on the transmitter. After deactivation of the radio transmitter, it may be reactivated by input of a PIN code or by a respective pushbutton, if necessary.

Figure 2:
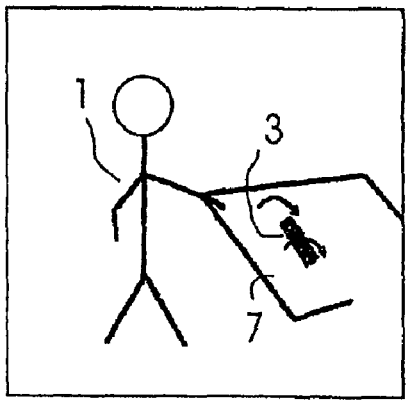
FIG. 2 shows the situation when the radio transmission device rolls after being released from the operator's hand.

According to FIG. 2, the operator 1 has lost the radio transmission device 3 from his hand, so that it rolls down a surface 7. This is an irregular movement state which is detected by the sensor unit and indicated as such. The radio transmitter 3 changes its radio transmission performance accordingly by issuing the emergency cutout control command and then by interrupting radio contact with the crane. Unintended activation of the crane and/or movements with a hazard potential is/are thus suppressed. Such deactivation is also triggered when, in the exemplary embodiment discussed here, the radio transmission device 3 rests with its front side (operating side) facing down on a substrate for a minimum duration of 2 seconds, for example. After deactivation of the radio transmitter, it can be reactivated.

Figure 3:
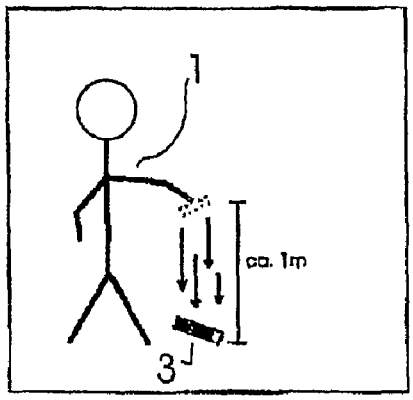
FIG. 3 shows the situation when the radio transmission device is dropped from the operator's hand at a height of approximately 1 meter.
Figure 4:
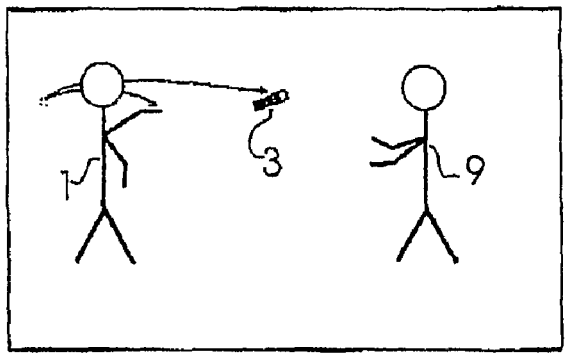
FIG. 4 shows the situation in which the operator throws the radio transmission device to another person.

FIG. 3 illustrates the situation in which the radio transmission device 3 has fallen out of the operator's hand, namely from a height of fall of approximately 1 meter. This situation also corresponds to an irregular movement state of the radio transmission device 3. The same applies to the situation indicated in FIG. 4, where an operator 1 is throwing the radio transmission device 3 to another person 9. The sensor unit with acceleration sensors detects this case situation, e.g., by detecting the "quasi-weightlessness" of an element in the radio transmission device, triggering emergency deactivation of the crane according to the radio transmission method and/or radio interruption method already described above with reference to FIGS. 1 and 2. The minimum duration of fall after which the radio transmitter detects the irregular movement state can be adjustable.

Preferably both the sensitivity of the acceleration detection and the monitoring dead times (delays in falling) can be programmed by a program intervention through a user interface in the display of the radio transmission device. This may be performed in various hierarchical levels by the user, his supervisor or only at the factory end.

The possible reactions described above may preferably also be set:

a) active delivery of an emergency cutout control signal by the radio transmitter,
b) passive emergency cutout information by interrupting the radio transmission,
c) combination of a) and b) on the radio transmission device (protected by access rights).

The invention claimed is:

1. Radio remote control unit for an operating device, comprising:

a radio transmitter for transmitting control command signals for the operating device; and a radio reception unit assigned to the operating device for receiving control command signals of the radio transmitter and for converting the control command signals into control signals for controlling operating functions of the operating device, wherein the radio transmitter has a sensor device for detecting at least one irregular force induction state and/or an irregular motion state and/or at least one irregular positional state of the radio transmitter and is equipped to alter its radio transmission performance in a specific manner on detection of the irregular state;

the radio reception unit is equipped to trigger an emergency control signal on detection of the specific change in the radio transmission performance of the radio transmitter to influence the operating functions of the operating device in a predetermined manner; and the sensor device is combined with a signal analyzer circuit which is equipped to analyze the sensor signals and to decide, on the basis of the analysis, whether a particular irregular state has occurred.

2. Radio remote control unit according to claim 1, wherein the specific change in the radio transmission performance of the radio transmitter includes sending an emergency signal.

3. Radio remote control unit according to claim 1, wherein the specific change in the radio transmission performance of the radio transmitter includes interrupting the radio transmitter's radio transmission operation.

4. Radio remote control unit according to claim 1, wherein the influence on the operating functions of the operating device by the emergency control signal includes stopping at least one operating function of the operating device.

5. Radio remote control unit according to claim 1, wherein the signal analyzer circuit indicates an irregular state when the radio transmitter executes a falling movement.

6. Radio remote control unit according to claim 1, wherein the signal analyzer circuit indicates an irregular state when the radio transmitter executes a rolling movement and/or a tumbling movement.

7. Crane as an operating device having a radio remote control unit according to claim 1, wherein the crane comprises a control means which restricts the degrees of freedom in the operating movement of the crane on triggering of the emergency control signal.

8. Crane according to claim 7, wherein the triggering of the emergency control signal comprises triggering an emergency deactivation of at least one degree of freedom of an operating movement.

9. Radio remote control unit for an operating device, comprising:

a radio transmitter for transmitting control command signals for the operating device; and a radio reception unit assigned to the operating device for receiving control command signals of the radio transmitter and for converting the control command signals into control signals for controlling operating functions of the operating device, wherein the radio transmitter has a sensor device for detecting at least one irregular force induction state and/or an irregular motion state and/or at least one irregular positional state of the radio transmitter and is equipped to alter its radio transmission performance in a specific manner on detection of the irregular state;

the radio reception unit is equipped to trigger an emergency control signal on detection of the specific change in the radio transmission performance of the radio transmitter to influence the operating functions of the operating device in a predetermined manner; and the sensor device comprises at least one acceleration sensor configured to detect the respective irregular state.

10. Radio remote control unit according to claim 9, wherein the at least one acceleration sensor is a piezoelectric sensor.

11. Radio remote control unit for an operating device, comprising:

a radio transmitter for transmitting control command signals for the operating device; and a radio reception unit assigned to the operating device for receiving control command signals of the radio transmitter and for converting the control command signals into control signals for controlling operating functions of the operating device, wherein the radio transmitter has a sensor device for detecting at least one irregular force induction state and/or an irregular motion state and/or at least one irregular positional state of the radio transmitter and is equipped to alter its radio transmission performance in a specific manner on detection of the irregular state;

the radio reception unit is equipped to trigger an emergency control signal on detection of the specific change in the radio transmission performance of the radio transmitter to influence the operating functions of the operating device in a predetermined manner; and the sensor device comprises at least one position sensor configured to deliver a signal indicating an irregular positional state of the radio transmitter when the radio transmitter is stored in a certain alignment relative to a substrate.

12. Radio remote control method for an operating device, comprising:

transmitting control command signals for the operating device from a radio transmitter;

receiving, with a radio reception unit assigned to the operating device, control command signals from the radio transmitter;

converting, with the radio transmitter, the control command signals into control signals for controlling operating functions of the operating device;

detecting, with a sensor device of the radio transmitter, at least one irregular force induction state and/or an irregular motion state and/or at least one irregular positional state of the radio transmitter;

analyzing signals of the sensor device with a signal analyzer circuit;

deciding, on the basis of the analysis, whether a particular irregular state has occurred;

altering the radio transmission performance of the radio transmitter in a specific manner on detection of the irregular state; and triggering an emergency control signal on detection of the specific change in the radio transmission performance of the radio transmitter to influence the operating functions of the operating device in a predetermined manner.

13. Radio remote control method according to claim 12, wherein the sensor device comprises at least one acceleration sensor; and the method further comprises detecting the respective irregular state with the at least one acceleration sensor.

14. Radio remote control method according to claim 12, wherein the sensor device comprises at least one position sensor; and the method further comprises delivering a signal from the at least one position sensor indicating an irregular positional state of the radio transmitter when the radio transmitter is stored in a certain alignment relative to a substrate.

15. Radio remote control method according to claim 12, further comprising indicating, with the signal analyzer circuit, an irregular state when the radio transmitter executes a falling movement.

16. Radio remote control method according to claim 12, further comprising indicating, with the signal analyzer circuit, an irregular state when the radio transmitter executes a rolling movement and/or a tumbling movement.

* * * * *